US006994828B2

(12) United States Patent
Viot

(10) Patent No.: US 6,994,828 B2
(45) **Date of Patent: *Feb. 7, 2006**

(54) LIQUID SAMPLE PIPETTE WITH TIP EJECTING MECHANISM

(75) Inventor: Francois Viot, Auvers-sur-Oise (FR)

(73) Assignee: Gilson S.A.S., Villiers le Bel (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/240,487

(22) PCT Filed: Apr. 9, 2001

(86) PCT No.: PCT/FR01/01072

§ 371 (c)(1),
(2), (4) Date: Jan. 29, 2003

(87) PCT Pub. No.: WO01/76752

PCT Pub. Date: Oct. 18, 2001

(65) Prior Publication Data

US 2003/0147781 A1 Aug. 7, 2003

(30) Foreign Application Priority Data

Apr. 7, 2000 (FR) ..... 00 04469

(51) Int. Cl.
*B01L 3/02* (2006.01)

(52) U.S. Cl. ..... 422/100; 73/864.14; 73/864.18

(58) Field of Classification Search ..... 422/100; 73/864.14, 864.11, 864.18
See application file for complete search history.

(56) References Cited

U.S. PATENT DOCUMENTS

| | | | | |
|---|---|---|---|---|
| 2,986,119 | A | 5/1961 | Roesler | |
| 3,497,305 | A | 2/1970 | König | |
| 3,604,267 | A | 9/1971 | Johns | |
| 3,766,785 | A * | 10/1973 | Smernoff | 73/864.14 |
| 3,882,729 | A | 5/1975 | Roach | |
| 3,918,308 | A * | 11/1975 | Reed | 73/864.14 |
| 4,164,870 | A | 8/1979 | Scordato et al. | |
| 4,263,257 | A | 4/1981 | Metsälä | |
| 4,268,481 | A | 5/1981 | Suovaniemi et al. | |
| 4,369,665 | A * | 1/1983 | Citrin | 73/864.18 |
| 4,442,722 | A | 4/1984 | Meyer | |
| 5,073,343 | A | 12/1991 | Hukuhara et al. | |
| 5,435,197 | A * | 7/1995 | Telimaa et al. | 73/864.14 |
| 5,650,124 | A | 7/1997 | Gilson | |
| 5,958,343 | A | 9/1999 | Astle | |
| 6,295,880 | B1 | 10/2001 | Gilson | |
| 6,779,412 | B2 | 8/2004 | Viot | |
| 6,833,114 | B1 | 12/2004 | Christen et al. | |
| 2003/0074989 | A1 | 4/2003 | Magnussen et al. | |
| 2003/0159525 | A1 | 8/2003 | Viot | |

FOREIGN PATENT DOCUMENTS

| | | |
|---|---|---|
| DE | 2954504 | 9/1986 |
| DE | 4339143 | 5/1995 |

(Continued)

*Primary Examiner*—Jan M. Ludlow
(74) *Attorney, Agent, or Firm*—Foley & Lardner LLP

(57) ABSTRACT

The sampling pipette comprises a body; an arm movable relative to the body parallel to a longitudinal direction of the pipette in order to eject a cone fixed to the body; and a button for controlling movement of the arm. The pipette is arranged in such a manner that the button applies sliding thrust on the arm while the arm is moving relative to the body.

19 Claims, 5 Drawing Sheets

FOREIGN PATENT DOCUMENTS

| | | |
|---|---|---|
| EP | 0566939 | 10/1993 |
| EP | 0704242 | 4/1996 |
| EP | 1268070 | 11/2003 |
| EP | 1268067 | 6/2004 |
| FR | 1166673 | 11/1958 |
| FR | 0004475 | 12/2002 |
| GB | 2029723 | 3/1980 |
| WO | WO 93/11870 | 6/1993 |
| WO | WO 96/04991 | 2/1996 |
| WO | WO 01/42759 | 6/2001 |
| WO | WO 01/76747 | 10/2001 |
| WO | WO 01/76748 | 10/2001 |
| WO | WO 01/76750 | 10/2001 |
| WO | WO 01/76751 | 10/2001 |
| WO | WO 01/76753 | 10/2001 |

* cited by examiner

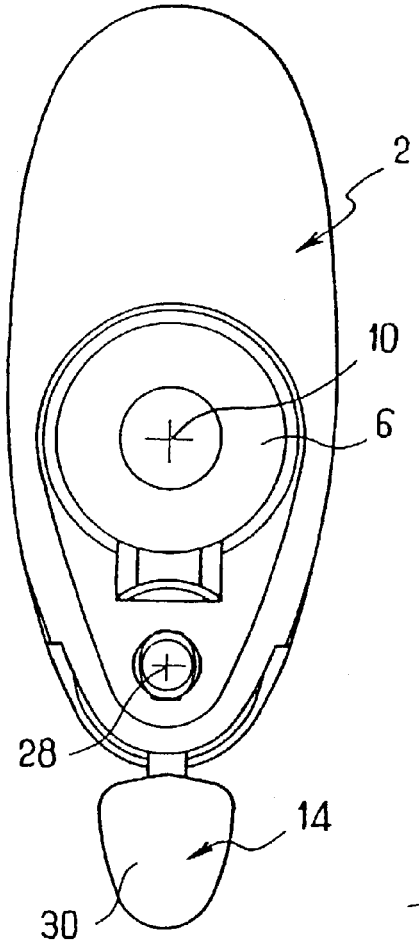
FIG_8
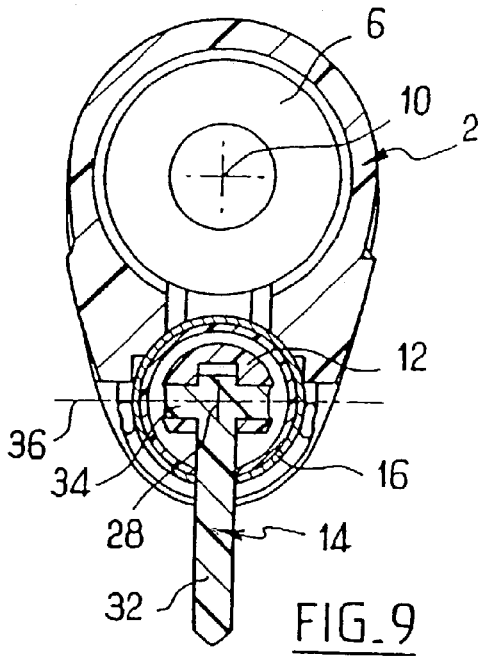
FIG_9
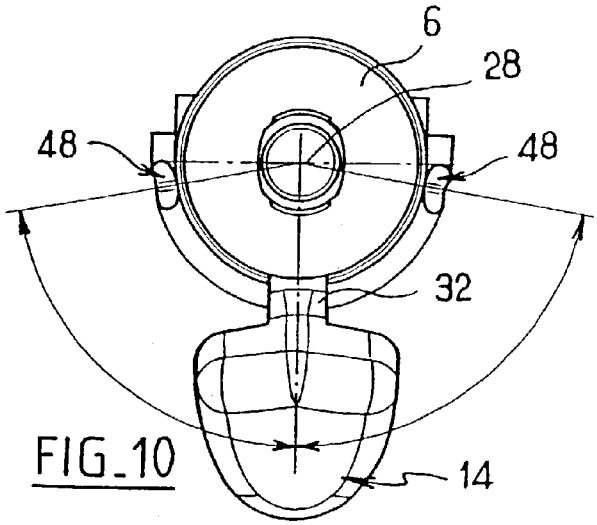
FIG_10
FIG_11
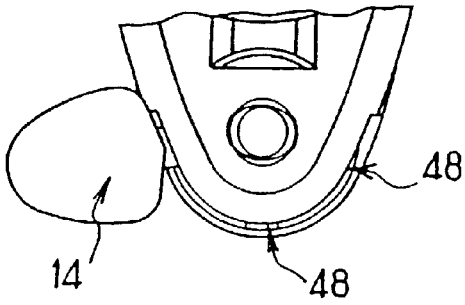
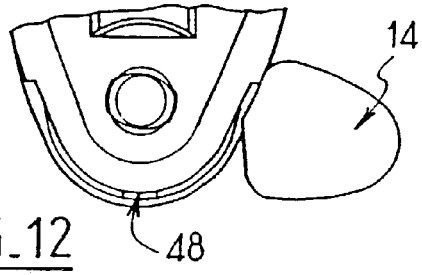
FIG_12

LIQUID SAMPLE PIPETTE WITH TIP EJECTING MECHANISM

The present invention relates to pipettes for taking samples of liquids.

Document EP-0 566 939 discloses a pipette comprising a body and an ejector arm that is slidably movable along the body to separate a cone from the pipette, which cone is held to the bottom end of the pipette by friction. The pipette has an ejector control button enabling the arm to be lowered by pressing on the button.

The button is hinged to the arm and is connected to the body of the pipette in such a manner that pressing down on the button alters its angle of inclination, and lowers the arm by the lever effect while also reducing the force a user needs to supply against the return spring of the ejector. Nevertheless, the parts of that ejector mechanism are relatively difficult to make and to assemble.

An object of the invention is to provide a pipette of a different type in which the ejector mechanism is easier to make and to assemble.

In order to achieve this object, the invention provides a sampling pipette comprising: a body; an arm movable relative to the body parallel to a longitudinal direction of the pipette in order to eject a cone fixed to the body; and a button for controlling movement of the arm; the pipette being arranged in such a manner that the button applies sliding thrust on the arm while the arm is moving relative to the body.

Thus, the connection between the button and the arm is particularly simple. These two parts are therefore easy to make and assemble so far as this connection is concerned.

The invention may also present at least any one of the following characteristics:

- the button is mounted free to turn relative to the body about an axis perpendicular to the longitudinal direction;
- the pipette includes an intermediate part mounted free to turn relative to the body about an axis parallel to the longitudinal direction, the button being mounted free to turn relative to the intermediate part about an axis perpendicular to the longitudinal direction;
- the button is directly connected to the intermediate part;
- the intermediate part is mounted free to turn relative to the arm about the axis parallel to the longitudinal direction;
- the intermediate part is connected directly to the body;
- the pipette includes a linking part that is movable relative to the body along an axis parallel to the longitudinal direction, the button being movable relative to said part via an opening in said part;
- the linking part is free to turn relative to the arm about the axis parallel to the longitudinal direction;
- the linking part is free to turn relative to the intermediate part about the axis parallel to the longitudinal direction;
- the linking part is directly connected to the intermediate part;
- the linking part is directly connected to the arm;
- the button is movable relative to the body in a plane perpendicular to the longitudinal direction, being free to occupy any position lying in a continuous range of positions in said plane, and enabling the arm to be moved into any position;
- the button is mounted free to turn relative to the body in said plane;
- the button is arranged to apply sliding thrust on the arm during movement of the button in said plane;

- the pipette includes means for identifying at least one predetermined position of the button relative to the body within said range;
- the pipette is a hand-held pipette;
- the pipette has a single channel; and
- the pipette is elongate in shape along the longitudinal direction.

Other characteristics and advantages of the invention appear further from the following description of a preferred embodiment given by way of non-limiting example. In the accompanying drawings:

FIG. 8 is a plan view showing the FIG. 1 pipette;

FIG. 9 is a horizontal section view on plane IX—IX through the FIG. 4 pipette;

FIG. 10 is a fragmentary view of the pipette analogous to FIG. 8, showing the angular stroke of the ejector button in a horizontal plane; and FIGS. 11 and 12 are two views analogous to FIG. 10, showing the extreme left position and the extreme right position of the button.

Figure 1:
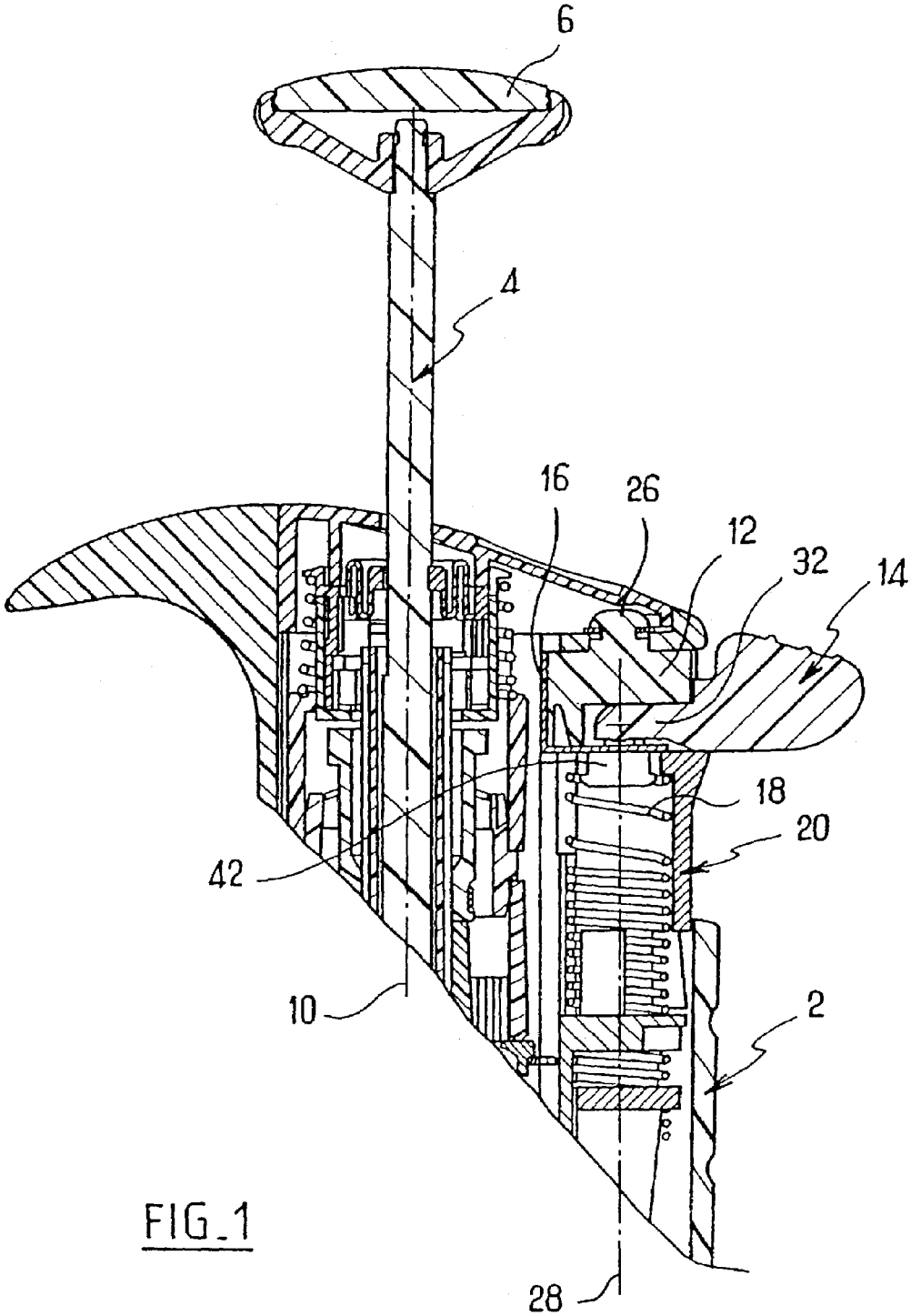
FIG. 1 is a fragmentary vertical axial section view of the top portion of a pipette of the invention.
Figure 2:
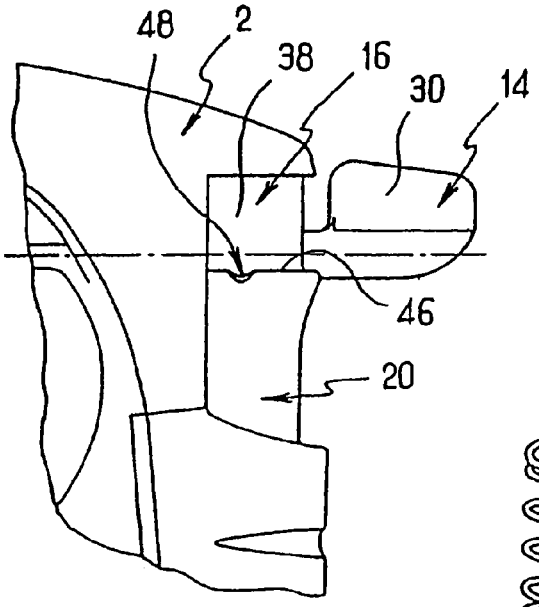
FIG. 2 is a fragmentary view showing the right-hand side of the FIG. 1 pipette.

The pipette constituting an embodiment of the invention and shown in FIG. 1 is a sampling pipette having a single channel, and numerous aspects thereof are known in themselves and are not described in detail herein. Specifically, the pipette comprises a rod 4 extending along an axis 10 and surmounted by a sampling control button 6 for controlling the sliding movement of a piston along the axis 10 inside a bottom cavity of the pipette in order to suck up a sample of liquid into said cavity or to expel it therefrom.

The bottom tip of the pipette is suitable for receiving a discardable cone held by friction and through which the sampled liquid passes. The pipette includes means for adjusting the volume of sample to be taken, which means may be of conventional type.

The pipette includes an ejector mechanism enabling the cone to be pushed downwards in the longitudinal direction in order to separate it from the pipette. The bottom portion of this mechanism is known in itself, and only the top portion is described herein.

Figure 3:
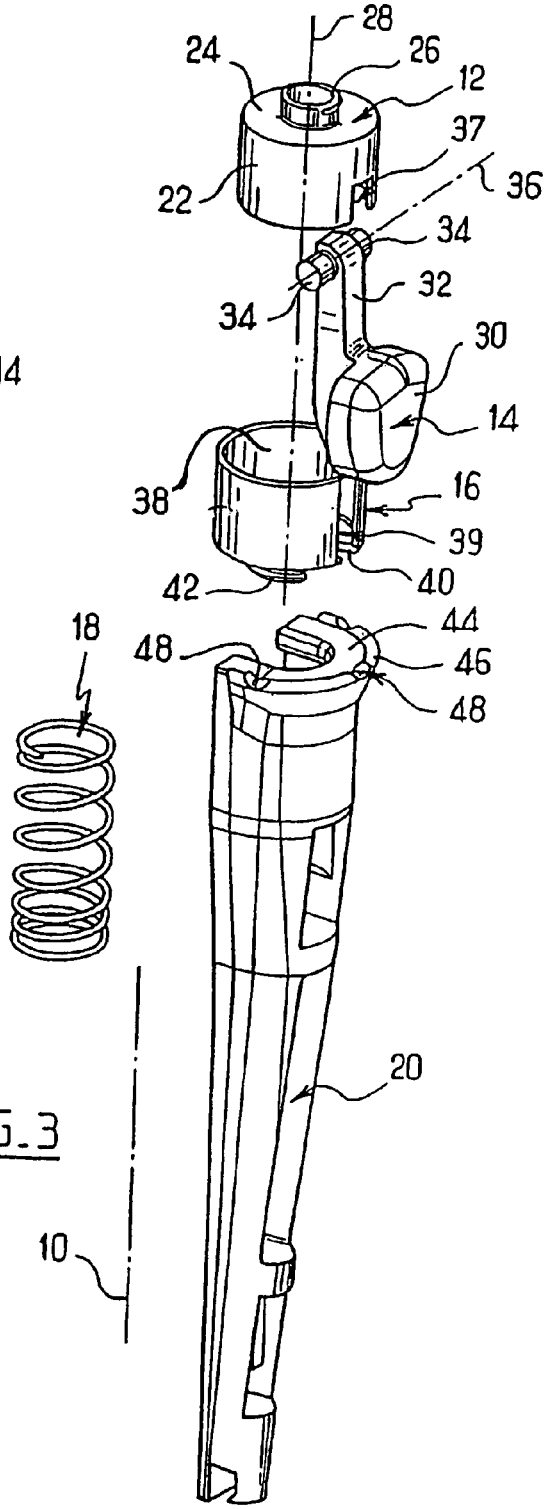
FIG. 3 is an exploded perspective view showing the top portion of the ejector mechanism of the FIG. 1 pipette.
Figure 4:
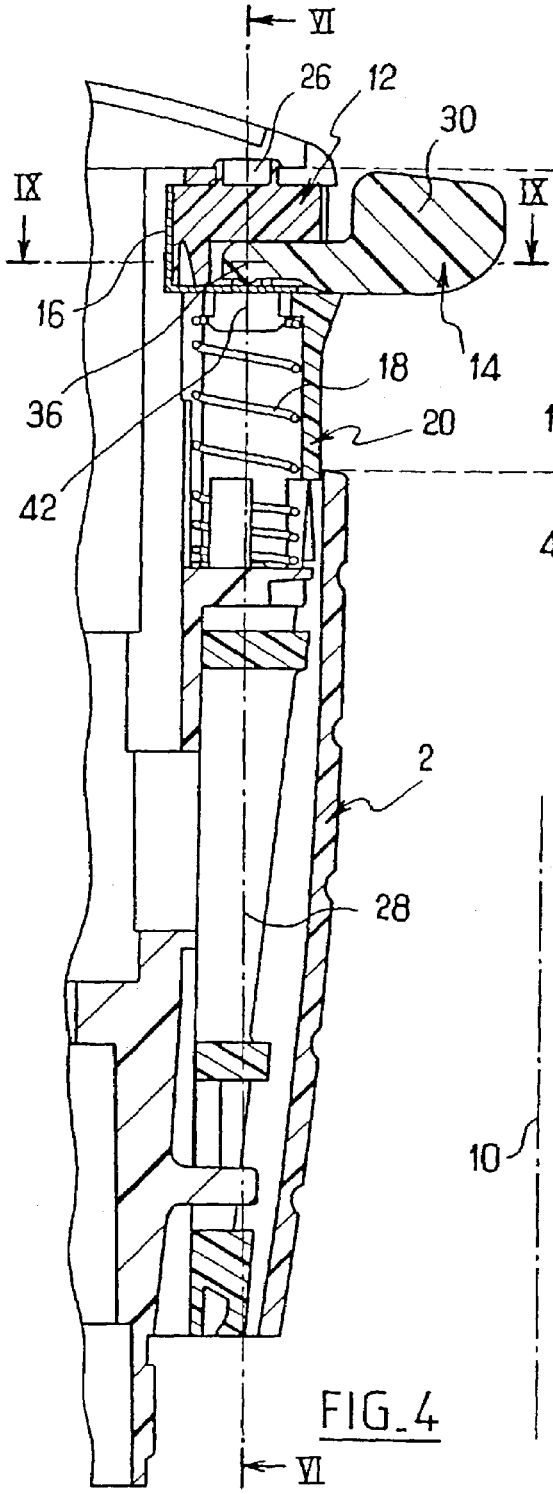
FIGS. 4 and 5 are two views analogous to FIG. 1, respectively showing the high position and the low position of the ejector.
Figure 5:
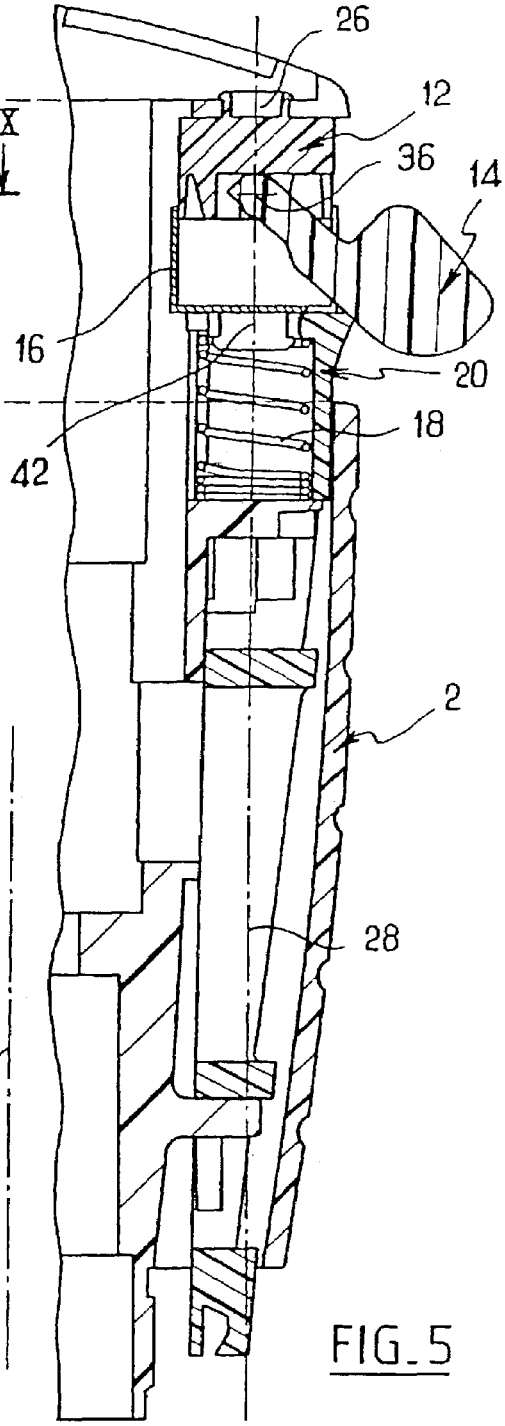
Figure 6:
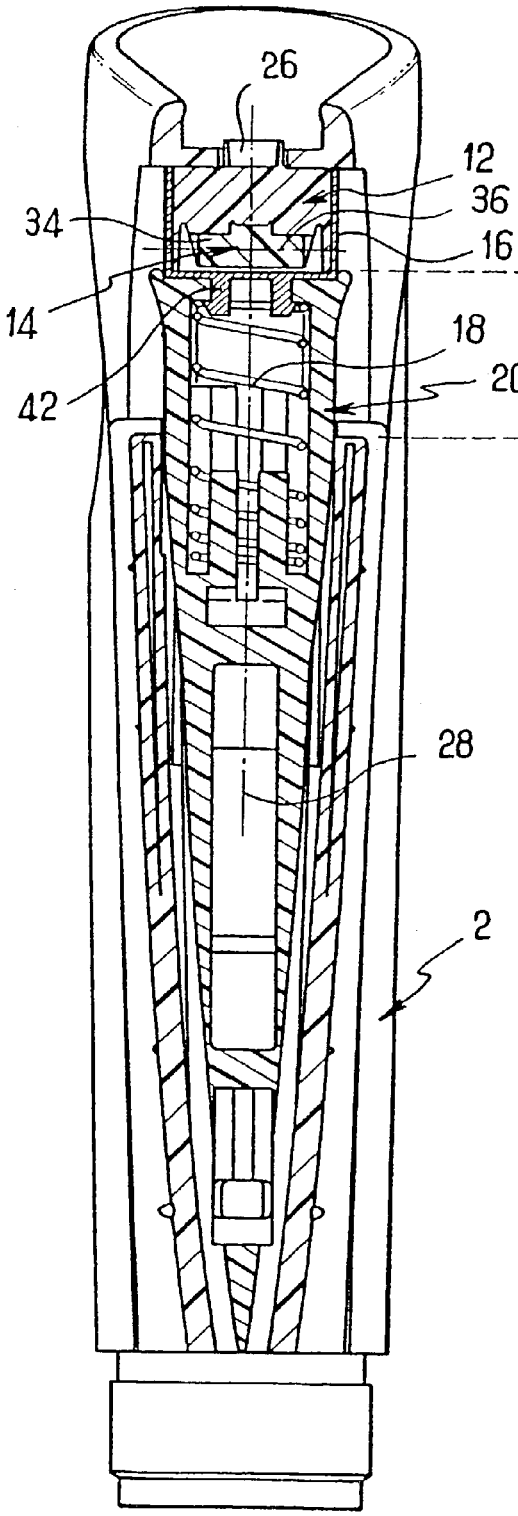
FIG. 6 is a vertical axial section view on plane VI—VI of the FIG. 4 pipette.
Figure 7:
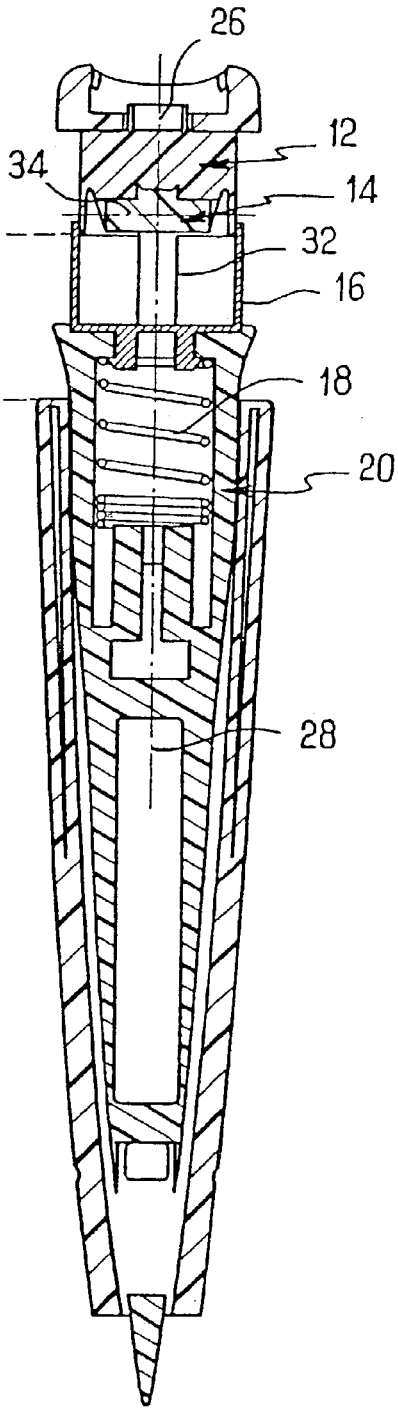
FIG. 7 is a view analogous to FIG. 6 showing the ejector in the low position.

With reference in particular to FIG. 3, the mechanism comprises a top cap 12, an ejector control button 14, a pivot guard 16, a spring 18, and an actuator 20.

The top cap 12 has a cylindrical side face 22 and a plane circular top face 24. The center of the top face is surmounted by a finger 26 received in an orifice of the body 2 and held in place by a washer. The finger enables the cap 12 to be turned relative to the body 2 about a vertical axis 28 parallel to the axis 10, and holds it stationary against sliding relative to the body.

The button 14 has an approximately flat actuation portion 30, a leg 32 extending sideways parallel to the actuation portion, and a shaft 34 perpendicular to the leg and projecting from either side thereof. The shaft is pivotally received in the top cap 12. The button is thus hinged to the cap about a horizontal axis 36 perpendicular to the vertical axes 10 and 28, and intersecting the axis 28. The side wall 22 of the cap has a notch 37 through which the leg 32 of the button extends while it is in the horizontal position. The cap is downwardly open.

The pivot guard 16 comprises a cylindrical wall 38 that is upwardly open and a plane circular bottom wall 40 with a finger 42 projecting downwards therefrom. The cap 12 extends inside the pivot guard 16 so that their side faces 22 and 38 face each other. The wall 38 presents a notch 39 extending up its full height and placed to coincide with the notch 37 of the cap, with the leg 32 passing therethrough. The pivot guard 16 is slidably movable relative to the cap 12 along the axis 28.

The top portion of the actuator 20 presents a plane wall 44 having a notch extending from its front edge to its center. This notch receives the finger 42 extending from the center of the wall 44. The bottom end of the finger is enlarged so as to prevent the pivot guard 16 moving in translation relative to the actuator 20 along the axis 28. The pivot guard 16 is thus free to turn relative to the actuator about the axis 28. It is pressed downwards against the wall 44 of the actuator. The actuator 20 has a U-shaped rim 46 extending from the edge of the wall 44, from the rear, the left, and the right thereof, and projecting upwards relative to the wall 44. The rim has notches 48, for example three notches as shown, or five notches, the notches extending downwards into the rim. One of the notches lies in the middle of the rear portion of the rim. The other two are respectively to the left and to the right of the wall 44. The leg 32 bears against the rim 46 and is capable of penetrating into one of the notches 48.

The spring 18 is housed inside the actuator 20 as shown in FIGS. 4 to 7. Its bottom end bears against the body 2 and its top end bears against the underside of the wall 44 to urge the actuator upwards. The actuator 20 is slidably movable in the body 2 along the axis 28. It is securely connected to a bottom rod (not shown) for making contact with the cone to be ejected.

The above-described structure makes two series of movements possible.

Firstly, with reference to FIGS. 10 to 12, the button 14 can be turned relative to the body 2 about the axis 28, i.e. in a horizontal plane perpendicular to the axis 28. It can move on either side of its rear or middle position through 80° in each direction. The left and right ends of these strokes, as shown in FIGS. 11 and 12, correspond to the leg 32 being received in the side notches 48. During this turning movement, the button 14, the top cap 12, and the pivot guard 16 move as a single unit turning about the axis 28. The actuator 20 does not move. The button may be placed in any position lying in its stroke of 160°, i.e. it may be engaged in the notches or it may lie outside them.

Furthermore, starting from any position of the button 14 relative to the body 2 about the axis 28, the button can be actuated downwards by the user acting on the portion 30. This action causes the button to pivot about the horizontal axis 36, thereby causing the pivot guard 16 and the actuator 20 to slide vertically along the axis 28. During this movement, the leg 32 bears against a single point of the rim 46, sliding over the rim in a plane that extends radially relative to the axis 28. The top cap 12 remains stationary. Lowering the actuator serves to eject the cone. Consequently, the cone can be ejected regardless of the position of the button about the axis 28, and in particular with the button to the left, to the right, or behind the pipette.

In practice, the two above-described movements can be combined at will while moving the button. The user is free to choose the position occupied by the button while it is at rest and its position while moving to eject a cone.

It can be seen that this mechanism provides great freedom in moving and positioning the button while still being of relatively simple structure. It is easy to make and to assemble.

In addition, since the sliding point of thrust between the button 14 and the actuator 20 extends between the actuation portion 30 and the shaft 34, the button acts as a lever reducing the amount of force that needs to be delivered in order to eject the cone.

The notches 48 constitute means for identifying preferred positions for the button relative to the rim (in this case behind, to the left, and to the right).

The characteristic relating to sliding thrust between the button and the actuator during ejection can be implemented independently of the characteristics relating to the button being free to move relative to the body in a plane perpendicular to the direction 10.

What is claimed is:

1. A sampling pipette comprising:

a sampling pipette body;

an actuator connected to the sampling pipette body wherein the actuator is movable in a longitudinal direction parallel to the sampling pipette body and configured to eject a cone from the sampling pipette body; and a control ejector button positioned above the actuator capable of downward actuation on the actuator wherein the control ejector button is movable relative to the sampling pipette body in a horizontal plane perpendicular to an axis parallel to the longitudinal direction, further wherein the control ejector button is movable about an axis perpendicular to the axis parallel to the longitudinal direction, and further wherein the control ejector button is movable independently of the actuator in the horizontal plane perpendicular to the axis parallel to the longitudinal direction.

2. The pipette according to claim 1 further comprising a top cap connected to the sampling pipette body wherein the ejector control button is mounted to the top cap, and further wherein the top cap is movable relative to the sampling pipette body in a horizontal plane perpendicular to the axis parallel to the longitudinal direction.

3. The pipette according to claim 2 further comprising a pivot guard connected to the actuator and the top cap wherein the pivot guard is movable in the longitudinal direction parallel to the sampling pipette body, and further wherein the pivot guard is movable in a horizontal plane perpendicular to the axis parallel to the longitudinal direction.

4. The pipette according to claim 3 wherein the pivot guard comprises a pivot guard finger.

5. The pipette according to claim 4 further comprising a notch in a top portion of the actuator wherein the pivot guard is moveably connected to the actuator when the pivot guard finger fits into the notch.

6. The pipette according to claim 2 wherein the top cap comprises a cylindrical side face and a plane circular top face with a finger.

7. The pipette according to claim 2 wherein the ejector control button is mounted to the top cap by a shaft.

8. The pipette according to claim 2 wherein the ejector control button comprises a leg, and the top cap comprises a notch wherein the leg is received within the notch.

9. The pipette according to claim 2 wherein the top cap is directly connected to the sampling pipette body.

10. The pipette of claim 2 wherein the top cap does not move in a longitudinal direction parallel to the sampling pipette body.

11. The pipette according to claim 3 wherein the pivot guard comprises an opening and further wherein the ejector control button is received within the opening.

12. The pipette according to claim 3 wherein the top cap fits within the pivot guard.

13. The pipette according to claim 12 wherein the top cap comprises a cylindrical side face and the pivot guard comprises a wall, and further wherein the cylindrical side face faces the wall.

14. The pipette according to claim 3 wherein the top cap, pivot guard, and control ejector button form a single unit movable in a horizontal plane perpendicular to the axis parallel to the longitudinal direction.

15. The pipette according to claim 1 further comprising a spring wherein the spring urges the actuator upwards in a longitudinal direction parallel to the sampling pipette body.

16. The pipette according to claim 1 wherein at least one preferred position for the ejector control button in the horizontal plane perpendicular to the axis parallel to the longitudinal direction is identified.

17. The sampling pipette according to claim 16 wherein the actuator further comprises a rim and at least one notch on the rim, and further wherein the preferred position is identified by the at least one notch on the rim.

18. The sampling pipette according to claim 1 wherein the sampling pipette comprises a single channel.

19. A sampling pipette comprising:

a sampling pipette body;

an actuator connected to the sampling pipette body wherein the actuator is movable in a longitudinal direction parallel to the sampling pipette body and configured to eject a cone from the sampling pipette body;

a control ejector button capable of downward actuation on the actuator wherein the control ejector button is movable relative to the sampling pipette body in a horizontal plane perpendicular to the axis parallel to the longitudinal direction, and further wherein the control ejector button is movable about an axis perpendicular to the axis parallel to the longitudinal direction, and further wherein the control ejector button is movable independently of the actuator in the horizontal plane perpendicular to the axis parallel to the longitudinal direction;

a top cap connected to the sampling pipette body wherein the ejector control button is mounted to the top cap, and further wherein the top cap is movable relative to the sampling pipette body in a horizontal plane perpendicular to the axis parallel to the longitudinal direction; and a pivot guard connected to the actuator and the top cap wherein the pivot guard is movable in the longitudinal direction parallel to the sampling pipette body, and further wherein the pivot guard is movable in a horizontal plane perpendicular to the axis parallel to the longitudinal direction.

* * * * *